US005515577A

United States Patent [19]

Pinto et al.

[11] Patent Number: 5,515,577

[45] Date of Patent: May 14, 1996

[54] BALE OPENER AND CLEANER

[75] Inventors: Akiva Pinto, Gastonia, N.C.; Guenter Lucassen, Haltern; Bernard Bocht, Neubulach, both of Germany

[73] Assignee: Hergeth Hollingsworth GmbH, Duelmen, Germany

[21] Appl. No.: 204,388

[22] PCT Filed: Sep. 18, 1992

[86] PCT No.: PCT/EP92/02164

§ 371 Date: May 9, 1994

§ 102(e) Date: May 9, 1994

[87] PCT Pub. No.: WO93/06272

PCT Pub. Date: Apr. 1, 1993

[30] Foreign Application Priority Data

Sep. 20, 1991 [DE] Germany ..... 41 31 424.7

[51] Int. Cl.[6] ..... D01G 7/06

[52] U.S. Cl. ..... 19/80 R

[58] Field of Search ..... 19/80 R, 80 A, 19/97.5, 145.5; 241/101.2, 101.72, 101.73

[56] References Cited

U.S. PATENT DOCUMENTS

| | | | |
|---|---|---|---|
| 3,736,624 | 6/1973 | Alt et al. | 19/80 R |
| 4,475,269 | 10/1984 | Goldammer | 19/80 R |
| 4,707,888 | 11/1987 | Binder et al. | 190/80 R |
| 4,712,275 | 12/1987 | Hösel et al. . | |
| 4,813,103 | 3/1989 | Walk et al. . | |
| 4,888,857 | 12/1989 | Pinto et al. | 19/80 R |
| 4,912,811 | 4/1990 | Walk | 19/80 R |
| 5,105,507 | 4/1992 | Staheli et al. | 19/80 R |
| 5,211,708 | 5/1993 | Rentsch et al. | 19/80 R |
| 5,276,946 | 1/1994 | Pinto et al. . | |

FOREIGN PATENT DOCUMENTS

| | | | |
|---|---|---|---|
| 3418999 | 11/1985 | Germany . | |
| 4038091 | 6/1992 | Germany | 19/80 R |

*Primary Examiner*—Michael A. Neas

*Attorney, Agent, or Firm*—Leatherwood Walker Todd & Mann

[57] ABSTRACT

An opening and blending device for pressed fiber bales, comprising a continuous fiber supply on a transport for feeding the pressed fiber bales to a reduction area. The device comprising a milling head guided on rails for reciprocating movement over the reduction area, with a transport plane of the transport extending at an angle to the reduction plane of the reduction area and comprising a suction channel for the removed fiber flocks. The milling head is arranged in an arm extending over the width of the transport and is supported on one side on a rail guide beams to be displaced thereon along the transport.

22 Claims, 3 Drawing Sheets

FIG.1
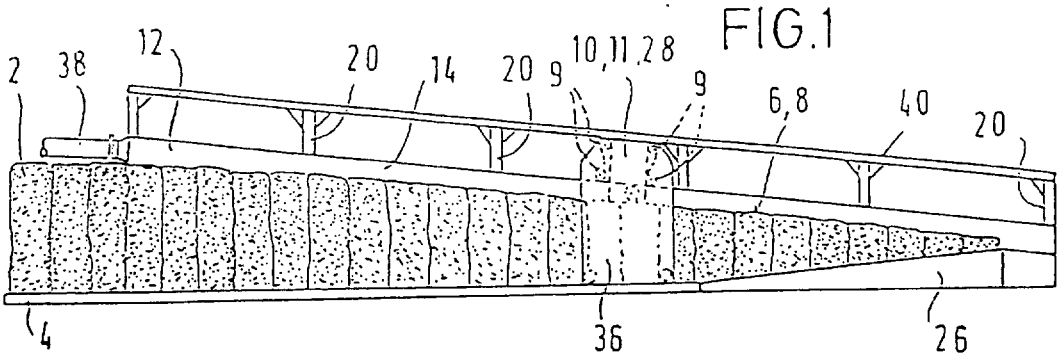
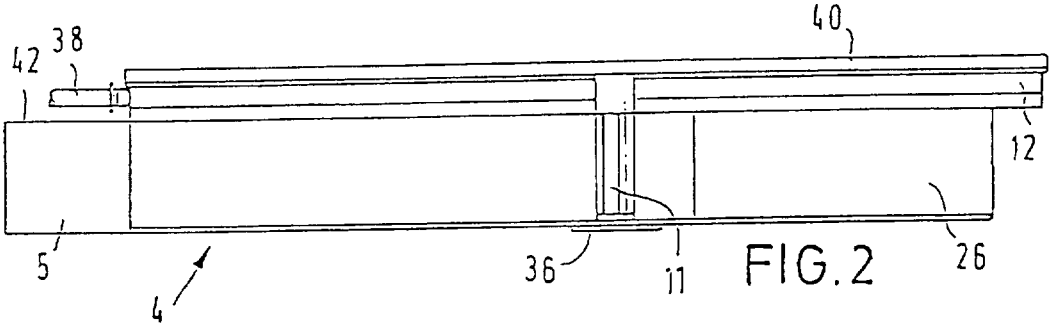
FIG.2
FIG.3
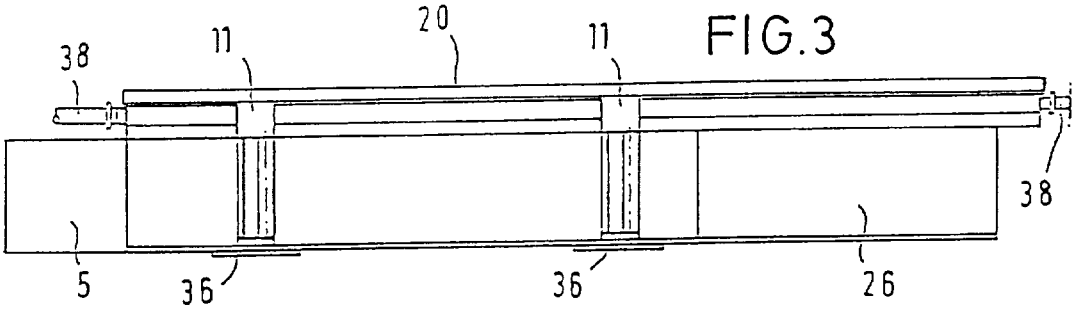
FIG.4
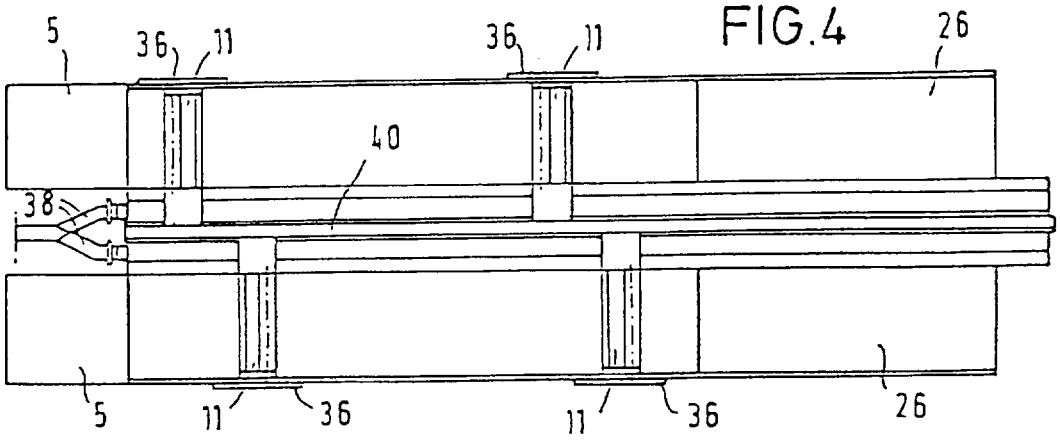

BALE OPENER AND CLEANER

BACKGROUND OF THE INVENTION

The invention is directed to an opening and blending device for pressed fiber bales, comprising a continuous fiber supply on a transport means for feeding the pressed fiber bales to a reduction area, and comprising a milling head guided on rails for reciprocating movement over the reduction area, with the transport plane of the transport means extending at an angle to the reduction plane of the reduction area, and comprising a suction channel for the removed fiber flocks.

An opening and blending device of the above type is known from DE 39 33 274, wherein, during the reduction process, pressed fiber bales positioned in rows of bales can be continuously fed in the lengthwise direction of the group of bales to be supplied. The pressed fiber bales are conveyed to a reduction area having a rail-guided milling head reciprocating thereabove in the horizontal direction, with the transport plane of the transport means extending at an angle to the horizontal reduction plane of the reduction area. The fiber flocks opened by the milling head are discharged through a suction channel. This known opening and blending device according to DE 39 33 274 is complicated, particularly with respect to the holding device for the suction channel, which is provided as a hose. Another disadvantage is caused in that, when using a hose, the transport flow is subjected to a high air resistance so that the energy demand for fiber transport is considerably increased.

In a further known arrangement wherein the suction channel is provided as a telescopic tube, the manufacturing costs are considerable, with another disadvantage resulting from the fact that the telescope sealing means are prone to wear due to the dust-laden air. Moreover, a telescopic suction channel requires complex holding means.

DE-C-36 37 580 discloses an apparatus for the suction of fiber material wherein the upper portion of a suction device for a take-off roller is guided by rails, with the rail guide means being provided with a suction channel for the fiber/transport air flow to be discharged. The illustrated device requires a separate holding and guiding means for the take-off roller and for the suction hood belonging to the suction device and being arranged above the take-off roller. Therefore, separate expenses are required for the movement and the guidance of the milling device and for the movement and the guidance of the upper portion of the suction device.

SUMMARY OF THE INVENTION

It is an object of the invention to reduce the space requirements and the constructional complexity of an opening and blending device of the above mentioned type.

For solving the above object, the invention provides an opening and blending device for pressed fiber bales, comprising a continuous fiber supply on a transport means for feeding the pressed fiber bales to a reduction area, and comprising a milling head guided on rails for reciprocating movement over the reduction area, with the transport plane of the transport means extending at an angle to the reduction plane of the reduction area, and comprising a suction channel for the removed fiber flocks, wherein the milling head is arranged in an arm extending over the width of the transport means and is supported, on one side and without a tower, on a sole rail guide means to be displaced thereon along the transport means, and wherein the rail guide means is formed as a hollow profile and can be used as a suction channel.

According to the invention, the milling head is arranged in an arm extending over the width of the transport means and is supported, on one side and without a tower, on a sole rail guide means to be displaced thereon along the transport means. Such a construction of the opening and blending device allows for cost-saving fastening of the rail guide means, e.g. on outer walls of an engine hall or on suitable support structures of an engine hall, thus eliminating the costs for a complicated machine rack or for arrangement of said arm in a displaceable tower, resulting in a considerable reduction of investment expenses while maintaining the working capacity of the opening and blending device. In a particularly advantageous manner, also the space requirements are considerably reduced in comparison with conventional multiple bale openers while at the same time there is safeguarded a 24-hour reserve of bales to be supplied.

It is provided that the rail guide means is formed as a hollow profile having the suction channel extending therein. Using the rail guide means as a suction channel permits further cost reduction since there is no need for an additional suction channel of telescopically variable length while at the same time providing a cost-saving support structure for the arm. The rail guide means with the integrated suction channel can be fastened in a simple manner e.g. to a wall.

The rail guide means is provided with a support and drive element which, when viewed in cross section, extends at an angle between about 30° and 60°, preferably 45°. The support and drive element allows optimum support of the projecting arm and simultaneously serves for reciprocating the arm in a simple manner along the transport means.

In one embodiment, it is provided that the rail guide means accommodates two arms adapted to be reciprocated independently from each other.

In this embodiment, the two arms can be supported either on one side of the rail guide means or on opposite sides of the rail guide means, with transport means being provided on both sides of the rail guide means. Reduction of the pressed fiber bales by two arms makes it possible in an advantageous manner to improve the blending of the removed fiber flocks because each milling head can work off one half of the reduction quantity. The reduction efficiency can be doubled with the same reduction quantity.

Both arms can also be moved over the reduction area in uncorrelated manner. If the arms are arranged on opposite sides of the suction channel, fiber flocks from two different groups of supplied bales can be blended with each other, the blending ratio between the fibers from the two groups of supplied bales being settable as desired. For example, it is possible to provide supply of natural fibers on one side of the rail guide means and of synthetic fibers on the other side, or to provide supply of cotton fibers of different origins on both sides. In this manner, the opening and blending device allows maximum flexibility in the supply of different blends of fibers without the need for a production stop for exchange of the group of bales to be supplied. A further advantage resides in that, in case of two groups of bales to be supplied, a production stop of the opening and blending device is not necessitated even when exchanging the group of bales to be supplied.

In a further embodiment, it is provided that the suction channel can be subjected to suction from both ends thereof. In this manner, an additional blending effect can be obtained by the division of the flow of flocks. If the arms are provided to project from both sides of the rail guide means, the rail guide means is preferably fastened on free-standing supports or is suspended on a ceiling structure.

The arm can be provided with a milling head which is pivotable about an axis extending orthogonally to the reduction area. This makes it possible to reciprocate the milling head over the reduction area not in rectangular orientation but under an angle to the longitudinal axis of the supplied bales and, in doing so, to change the angular orientation e.g. with each reciprocating movement for preventing formation of gaps caused by the milling disks of the milling head.

Further, the arm can be provided with a milling head pivotable about an axis extending in parallel to the suction channel or about a horizontal axis. The upwardly pivotable milling head allows access to the milling head in case of malfunction without the need to remove the supplied bales.

The transport means can be adjusted in width and preferably comprises two transport chains for advancing the pressed fiber bales. The end portion of the transport means terminates in a ramp extending in the direction of the reduction area. This ramp increases the supply quantity for the pressed fiber bales arranged thereon when these are advanced by the transport means.

It can also be provided that a protective wall is arranged on the side of the milling head facing away from the suction channel, the protective wall being movable together with the milling head along the transport means. This protective wall prevents the respective pressed fiber bale arranged on the outermost side of the arm from tilting, precludes dropping of tufts of fibers and at the same time offers protection against accidents. The protective wall is moved back and forth on rails along with the milling head, the milling head being slidable up and down on the protective wall.

BRIEF DESCRIPTION OF THE DRAWINGS

Embodiments of the invention will be explained in greater detail hereunder with reference to the drawings.

FIG. 1 shows a first embodiment of the opening and blending device;

FIG. 2 shows a plan view of the embodiment of FIG. 1;

FIG. 3 shows a plan view onto another embodiment;

FIG. 4 shows a third embodiment provided with two transport paths;

DETAILED DESCRIPTION OF THE PREFERRED EMBODIMENT

Figure 5:
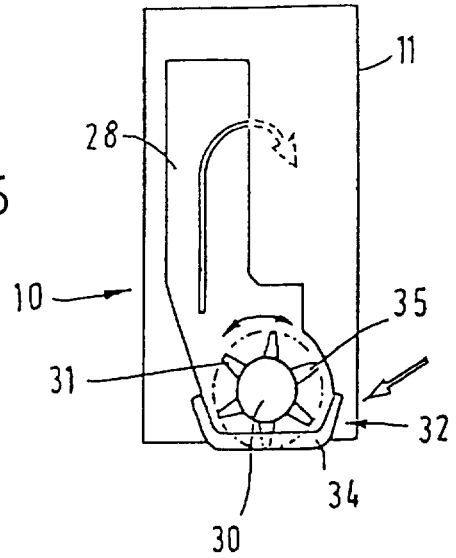
FIG. 5 shows the arrangement of the milling head.

The opening and blending device for pressed fiber bales 2 shown in FIG. 1 comprises a rail-guided milling head 10 arranged in an arm portion 11 and adapted to be moved over a reduction area 6 at angle to the horizontal line and to the transport plane of a transport means 4. The transport means 4 comprises at least one transport path 5 allowing forward and backward movement of the group of supplied bales consisting of a plurality of pressed fiber bales 2 arranged behind each other and, as the case may be, beside each other.

The end portion of the transport means 4 comprises a ramp 26 whereon the pressed fiber bales 2 are shifted upwardly due to the successive pressed fiber bales 2 following on transport path 5. In the region of ramp 26, which ascends towards reduction area 6, the supply of the pressed fiber bales 2 arranged on the ramp is intensified. Further, ramp 26 allows for shorter length dimension of the opening and blending device.

Milling head 10 is provided with a suction hood 28 wherein the fiber flocks taken off during the reduction of the bale surface are supplied to a suction channel 12, said suction channel 12 forming at the same time a rail guide means 14 for the arm 11 containing the milling head 10. Thus, arm 11 is supported only on one side on said rail guide means 14 combined with suction channel 12, and is adapted for movement along transport means 4.

Movement of arm 11 along with milling head 10 over reduction area 6 can be performed by control through a preset program. At the beginning of a new group of bales to be supplied, when only few bales rest on transport means 4, milling head 10 will move only over that portion of reduction area 6 which has pressed fiber bales 2 arranged thereon. To this purpose, arm 11 can be provided with suitable sensors 9.

Suction channel 12 is provided with a suck-off connection 38 on one side only while it is also possible to provide suction connections on both ends of suction channel 12.

In case of two suction connections per suction channel, the sucked transport air stream for the fiber flocks is divided. When the suction connections are unified again to form a common conduit, there is generated a blending effect unless the infeed of fiber flocks through suction hood 28 takes place exactly in the middle between the ends of the suction channel.

The inclination angle of reduction plane 8 having the reduction area 6 arranged therein, to the horizontal line is about 5° to 10°, and is 6° in the embodiment of FIG. 1. Also the ramp angle of ramp 26 is at an angle of climb between 5° and 10°.

Along transport means 4, also in the region of ramp 26, a protective wall 36 for the pressed fiber bales 2 is moved on rails synchronously with arm 11 so that no lumps of fibers can fall down from the pressed fiber bales 2 in the environment of milling head 10, while obtaining an effective protection against accidents at the same time. On the side of the pressed fiber bales 2 opposite to protective wall 36, a support wall 42 can extend along the whole length of transport means 4 for lateral guidance of the pressed fiber bales 2. Protective wall 36 can have windows formed therein for allowing inspection of the milling range during operation.

Guidance of arm 11 on protective wall 36 can be performed in the manner of guiding slots so that arm 11 can move up and down relative to protective wall 36. However, arm 11 is not supported in vertical direction on protective wall 36.

The rail guide means 14 with the integrated suction channel 12 is fastened on a suitable support structure, e.g. on the outer walls of an engine room or on supports of the engine hall structure, or, as shown in FIG. 1, on free-standing supports 20 allowing free-standing positioning within an engine hall. Strings of cables can extend in a rail-like hollow profile 40 arranged on said supports 20 parallel to suction channel 12.

FIG. 2 shows a plan view of the opening and blending device of FIG. 1 having a sole arm 11. The transport paths 5 of transport means 4 terminate on ramp 26 at whose end the reduction of a pressed fiber bale is completed.

FIG. 3 shows a plan view of an embodiment comprising two arms 11 adapted to be moved over the group of supplied bales independently from each other.

FIG. 4 shows a further embodiment with two arms 11 which in this embodiment are arranged on both sides of a support structure and make it possible to achieve blending of the removed fiber flocks from two different groups of bales being continuously supplied on two transport means 4. Arms 11 can be moved either independently from each other or be mechanically coupled in such a manner that they move in opposite senses. Thus, when one of arms 11 is moving downwardly, the other one can be lifted upwardly whereby driving energy is saved.

Independent movement of arms 11 yields advantages regarding an improved blending of the removed fiber flocks. In case of two arms provided for reduction, the reduction quantity per passage of milling head 10 can be decreased to one half thereof, resulting in a considerably improved blending.

In addition to the improved blending effect, use of two arms 11 offers the further advantage that the removed fiber flocks are of smaller size and that the opening and blending device can operate at a higher reduction speed.

Further, also different groups of bales can be supplied on both sides of the opening and blending device whereby, in a sole device, different groups of fibers can be immediately supplied to the successive carding machines or the like just as desired and without changing the group of bales to be supplied.

In the embodiment of FIG. 4, there are provided two parallel suction channels 12 which, however, can be unified again at their ends.

FIG. 5 is a schematic cross-sectional view of arm 11 with milling head 10. Arm 11 is pivotable about an axis extending orthogonally to reduction plane 8 so that arm 11 can be set to a desired angular position with respect to the orthogonal line to suction channel 12 and to transport means 4, respectively. It is also possible that arm 11 during the reduction of the pressed fiber bales 2 is pivoted in an oscillating manner about an orthogonal line to suction channel 12 over reduction area 6. The reduction of pressed fiber bales with an inclined or oscillating arm 11 has the effect that the milling disks 31, arranged side by side with each other on milling roller 30, do not work any gaps into the surface of the pressed fiber bales. Thus, it is also possible to change the angular orientation of arm 11 only once for each passage.

Arm 11 can also be pivoted about a horizontal axis or an axis parallel to suction channel 12 so that in case of malfunction, after shifting the protective wall 36, the region under arm 11 can be accessed without the need to move back the supplied bales.

Milling head 10 comprises a sole milling roller 30 rotatable in both directions of rotation and provided with a plurality of milling disks 31 arranged side by side to each other and having teeth 35 symmetrically interleaved thereon. The interleaving of teeth 35 creates the effect of air shovel blades. Other than in the arrangement shown in FIG. 5, the milling roller can also comprise only three teeth 35 spaced from each other by an angle of 120°.

Milling head 10 does not need additional pressure rollers arranged on both sides of the sole milling roller 30 but only a grid 34 having a suction slot 32 arranged on one side of milling roller 30. On the side opposite to suction slot 32 relative to milling roller 30, there is provided a suction hood 28, arranged—when seen in cross section—at a lateral displacement from the milling roller axis, for supplying the removed fiber flocks to suction channel 12. No air suction slot is provided on the side of suction hood 28.

The circle of engagement of milling disks 31 ends flush with the lower edge of grid 34.

Figure 6:
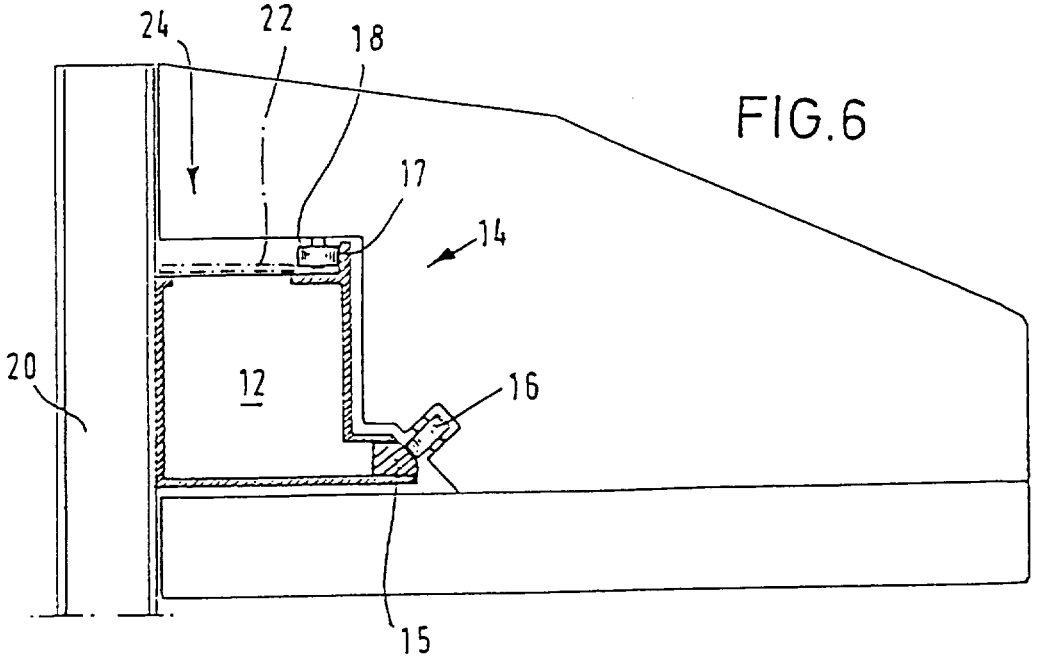
FIG. 6 shows a cross-sectional view of the rail guide means fastened to a support means.

FIG. 6 shows a cross-sectional view of the rail guide means 14 with the integrated suction channel 12. Suction channel 12 can have substantially rectangular cross section and is closed in upward direction— within a suction slot 24—by a flexible cover 22 held open only in the region of suction hood 28. On the side facing away from support 20 and the wall, respectively, there is arranged, at the lower end of suction channel 12, a support and drive element 15 extending at an angle of preferably 45°, for support of arm 11 through a plurality of rollers 16 rolling on said support and drive element 15. On the upper side of suction channel 12, there is provided a further support and drive element 17 formed as a projecting edge standing in upward direction in parallel to suction channel 12. Arm 11 engages said further support and drive element 17 through further rollers 18 so that there is a double support of arm 11 on rail guide means 14 through said rollers 16,18. Rollers 16 or 18, or 16 and 18, can be connected to a drive motor 44 for moving the arm 11 back and forth along rail guide means 14. Preferably, the driven rollers are subjected to the weight of arm 11 to ensure slippage-free transport of arm 11.

Figure 7:
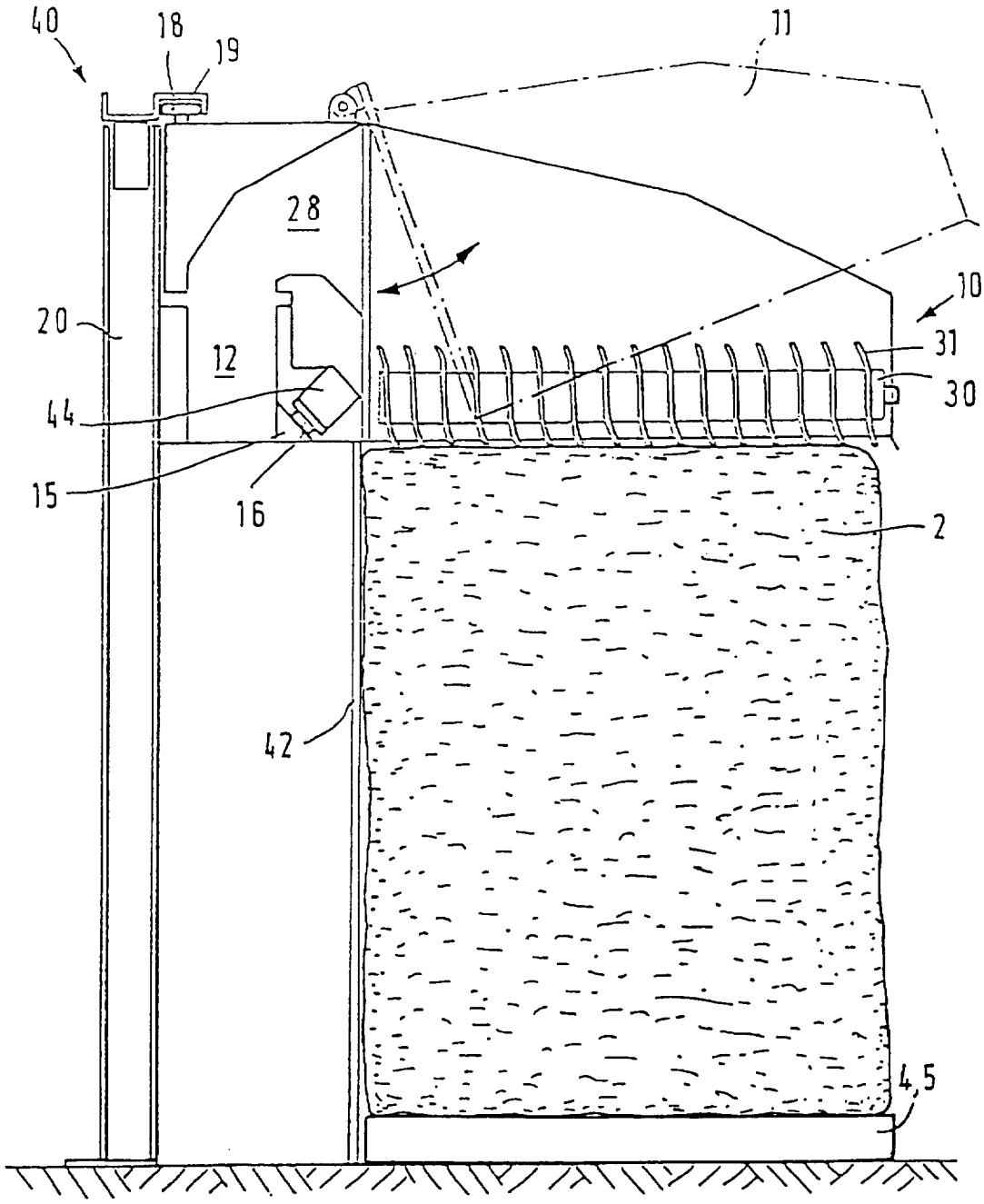
FIG. 7 shows a cross-sectional view of the opening and blending device.

Instead of the support and drive element 17, a corresponding rail profile 19 can be provided on hollow profile 40, with rollers 18 of arm 11, rotating about an axis extending orthogonally to suction channel 12, rolling on said rail profile 19 as shown in FIG. 7.

The flexible cover 22 in suction slot 24 of suction channel 12 can be lifted off suction channel 12 in the region of milling head 10 by means of guide rollers 9 and be guided around above suction hood 28, as is shown in FIG. 1, for enabling entrance of the fiber flocks from the suction hood into the suction channel.

It can also be provided that the flexible cover 22 is fastened on both sides of suction hood 28, cover 22 being moved along in the direction of suction slot 24 corresponding to the movement of milling head 10 and at the ends of suction channel 12 being rolled up by suitable roll-up means.

We claim:

1. An opening and blending device for fiber bales, having a reduction area for reducing the fiber bales, the reduction area including a reduction plane, the opening and blending device comprising:

transport means for transporting the fiber bales to the reduction area, said transport means defining a transport plane about which the bales are transported;

an arm extending over said transport means and means connected to said arm for moving said arm into said reduction area;

a milling head carried by said arm, said milling for reciprocating movement about said reduction area; said milling head including a drive motor for driving said milling head; said transport plane extending at an angle with respect to the reduction plane; and a rail guide extending adjacent said transport means, said arm having a first end connected to said rail guide and a second substantially free end opposite said first end, such that said arm is supported in substantially a cantilever fashion by said rail guide; said rail guide allowing movement of said arm about said transport means, and said rail guide defining a suction passage extending therein for allowing a suction flow to be drawn therethrough.

2. The opening and blending device according to claim 1, wherein said rail guide is provided with a drive element substantially extending at an angle between 30° and 60° with respect to horizontal.

3. The opening and blending device according to claim 1, wherein said rail guide includes a first arm and a second arm, each being adapted to be reciprocated independently with respect to one another.

4. The opening and blending device according to claim 1, wherein said suction passage is a channel having a first end and a second end, each of said first end and said second ends being adapted for allowing a suction flow therethrough.

5. The opening and blending device according to claim 1, further comprising at least one free-standing support for supporting said rail guide and wherein said arm and said transport means extend on one side of said free-standing support.

6. The opening and blending device according to claim 5, further comprising a second arm, said first and second arms being connected together to move in opposite directions with respect to one another.

7. The opening and blending device according to claim 1, wherein said milling head is configured to pivot about an axis extending orthogonally with respect to said reduction plane.

8. The opening and blending device according to claim 1, wherein said milling head is configured to pivot about an axis extending substantially parallel to said suction passage.

9. The opening and blending device according to claim 1, wherein said transport means defines a path width, and further comprises means for adapting said path width to correspond to the width of the fiber bales.

10. The opening and blending device according to claim 1, wherein said transport means includes an end portion, said end portion including a ramp extending upwardly towards said reduction area.

11. The opening and blending device according to claim 1, wherein said milling head includes a sole milling roller.

12. The opening and blending device according to claim 1, wherein said milling head includes a suction hood for carrying the fibers removed from the fiber bales by said milling head to said suction passage, said suction hood being laterally displaced from said milling head.

13. The opening and blending device according to claim 11, wherein said sole milling roller is configured to be rotated in either of two directions.

14. The opening and blending device according to claim 12, wherein said milling head defines a side opposite from said suction hood, such side of said milling head defining a single suction slot extending substantially parallel with said milling roller.

15. The opening and blending device according to claim 1, wherein said transport means includes means for moving the fiber bales towards and away from said reduction area.

16. The opening and blending device according to claim 1, wherein said milling head includes a suction hood and wherein said suction passage includes a suction slot having a flexible cover, said suction hood defining an entrance region, and said flexible cover being adapted for keeping said suction slot open primarily in the vicinity of said entrance region of said suction hood.

17. The opening and blending device according to claim 1, wherein said milling head includes a side facing away from said suction passage, such side of said milling head including a protective wall which moves together with said milling head along said transport means.

18. The opening and blending device according to claim 1, wherein said at least one arm includes sensors for detecting the presence of fiber bales proximate said reduction area, such that in response to said sensors, said arm is moveable over a predetermined portion of said reduction area having fiber bales arranged therein.

19. The opening and blending device according to claim 1, wherein said rail guide means is fastened to a wall structure.

20. The opening and blending device according to claim 1, further comprising drive means for moving said at least one arm, said drive means being carried by said at least one arm.

21. The opening and blending device according to claim 1, further comprising drive means for moving said at least one arm, said drive means including a drive roller, said drive roller being adapted for carrying substantially the entire weight of said arm.

22. The opening and blending device according to claim 1, wherein said milling head is configured to pivot about a horizontal axis.

* * * * *